US005350422A

United States Patent [19]

Burkinshaw et al.

[11] Patent Number: 5,350,422

[45] Date of Patent: Sep. 27, 1994

[54] PROCESS FOR IMPROVING THE FIXATION OF DYES ON MATERIALS CONTAINING AMIDE GROUPS

[75] Inventors: Steven M. Burkinshaw, Wetherby; Roy Gordon, Bolton; David J. Marfell, Harrogate; Kakoma D. Maseka, Leeds, all of England

[73] Assignee: Imperial Chemical Industries, PLC, London, England

[21] Appl. No.: 13,318

[22] Filed: Feb. 4, 1993

[30] Foreign Application Priority Data

Feb. 5, 1992 [GB] United Kingdom ..... 9202375.3

[51] Int. Cl.[5] ..... D06M 15/00; C09B 67/00

[52] U.S. Cl. ..... 8/115.56; 8/554; 8/924; 8/94.2

[58] Field of Search ..... 8/115.56, 94.24, 115.6, 8/554, 924, 94.2

[56] References Cited

U.S. PATENT DOCUMENTS

| | | | |
|---|---|---|---|
| 4,475,918 | 10/1984 | Kissling et al. | 8/554 |
| 4,592,758 | 6/1986 | Fikentscher et al. | 8/554 |
| 4,718,918 | 1/1988 | Heller et al. | 8/554 |
| 4,728,337 | 3/1988 | Abel et al. | 8/554 |
| 4,838,896 | 6/1989 | Kissling et al. | 8/554 |
| 4,964,875 | 10/1989 | Hendricks et al. | 8/554 |
| 5,207,802 | 5/1993 | Baumann | 8/557 |
| 5,224,963 | 7/1993 | Dix et al. | 8/94.21 |

*Primary Examiner*—Paul Lieberman
*Assistant Examiner*—Margaret Einsmann
*Attorney, Agent, or Firm*—Cushman, Darby & Cushman

[57] ABSTRACT

A process which comprises submitting a polyamide textile material, which has been dyed with an acid dye and subsequently treated with an acidic syntan, to treatment with a cationic agent having a plurality of cationic centers.

6 Claims, No Drawings

PROCESS FOR IMPROVING THE FIXATION OF DYES ON MATERIALS CONTAINING AMIDE GROUPS

This specification describes an invention relating to a process for improving the fixation of dyes, especially acid dyes, on materials containing amide groups, especially polyamide textile materials such as nylon, especially with respect to wet-fastness of the dyes on the textile material.

The introduction of increasingly fine synthetic polyamide yarns, especially micro-fibre yarns, gives rise to problems with dyeing because of the greatly increased surface area of the fibre with respect to volume. This requires the application of increased amounts of dye per unit weight and thus an increased amount of residual dye on or close to the surface of the fibre after dyeing. It is, therefore, important to increase the fixation of the dye to the fibre so that the tendency for removal during washing is reduced.

According to the present invention there is provided a process which comprises submitting a dyed syntanned polyamide textile material, which has been dyed with an acid dye and subsequently treated with an acidic syntan, to treatment with a cationic agent having a plurality of cationic centres.

The polyamide textile material can be a natural material such as wool or fur, but is preferably a synthetic polyamide material such as nylon, especially nylon 6.6. Although the process will provide increased fastness with any grade of dyed syntanned polyamide material, it is especially beneficial with the textile materials comprising yarns made with very fine filaments of 2 decitex per filament (dtxpf) and below, and more especially beneficial with the so-called "micro-fibres", i.e. yarns which made with filaments of 1 dtexpf and below. Decitex per filament is defined as the quotient of the decitex (dtex) of the yarn (dtex is the weight in grammes of 10,000 metres of yarn) and the number of filaments (f) in the yarn. Yarn is generally described by a term such as, "dfn", where d is the decitex of the yarn and n is the number of filaments, from which the dtexpf can be calculated as the ratio d/n. For example, if the yarn is described as "167f30" the decitex is 167 (the weight of 10,000 m is 167 g), the number of filaments in the yarn is 30 and the dtexpf is 167/30 or 5.57.

The textile material is preferably dyed with an acidic dye containing sulphonic and/or carboxylic acid groups, such as a dye from the range of Acid and Direct dyes which are described in the Colour Index. Especially suitable dyes are monosulphonic acid dyes such as CI Acid Yellow 199, CI Acid Orange 67, CI Acid Red 266 and CI Acid Blue 25; disulphonic acid dyes such as CI Acid Red 138 and CI Acid Green 27; pre-metallised, "disperse-type" (i.e. unsulphonated) acid dyes such as CI Acid Yellow 119, CI Acid Red 126 and CI Acid Black 63; premetallised monosulphonic acid dyes such as CI Acid Orange 144, CI Acid Red 359 and CI Acid Black 107; premetallised, disulphonic acid dyes such as CI Acid Brown 384, CI Acid Violet 90 and CI Acid Blue 193; and Direct dyes, such as CI Direct Yellow 12, CI Direct Red 81 and CI Direct Blue 293.

The acidic dye may be applied to the textile material by any conventional dyeing process. In a typical conventional dyeing process the dye is dissolved in a neutral or slightly acidic dyebath liquor containing the substrate and the dyebath temperature is raised to the boil, or above. For medium to heavy shades of dyeing, gradual additions of acid may be made to improve the exhaustion of the dye onto the fibre. Alternatively, all the additional acid required to achieve full exhaustion may be added initially and the temperature of the dyebath liquor raised at a carefully controlled rate. In either process it is generally beneficial to add auxiliary products to the dyebath liquor in order to improve the distribution of the dye over the fibre (levelness) and avoid barriness.

The acidic syntan used in the subsequent treatment is well-known in the dyeing art and is generally similar to the synthetic tanning agents used in the tanning of leather. It may be applied by any of the well-known processes for applying such products to a dye polyamide textile material, such as those described in the article by Cook in Rev. Prog. Color. (1982) 12, 73 (at 81 et seq). Typical syntans are polyarylsulphonates and polyphenols derived from arylsulphonic acids, phenols and bis-phenols by reaction with aldehydes, especially formaldehyde, or sulphur. A preferred syntan is a condensate of formaldehyde and Bis-phenol A which is commercially available as MATEXIL FA-SNX (ICI).

The cationic agent is preferably a polymer of a cationic monomer or co-polymer of a cationic monomer and another co-monomer which may, but need not, have a cationic centre. Especially preferred cationic agents have a plurality of amino groups and/or quaternary ammonium groups such as the polyamines disclosed in Kirk-Othmer Encyclopaedia of Chemical Technology Vol 10, page 500-6 as Cationic Flocculating Agents, the contents of which are incorporated herein by reference.

Suitable cationic monomers are amines and amides. Examples of such monomers are ammonia; monofunctional amines, e.g. mono- and di-alkylamines such as methylamine, ethylamine, dimethyl-amine and diethylamine, and mono- and di-alkylbenzylamines, such as N-methylbenzylamine and N,N-dimethylbenzylamine; polyfunctional amines, e.g. alkylene-diamines and -tetramines such as ethylene-diamine; dicyandiamide; melamine; urea and guanidine, all of which are reactive with comonomers such as: simple aldehydes, e.g. formaldehyde; alkylating agents, e.g. alkylenedihalides such as dichloroethane and dihaloethers such as 2,2'-dichlorodiethylether; and epoxides and haloepoxides such as epichlorohydrin; to give polyamines. Other suitable cationic monomers are alkyleneimines, especially ethyleneimine, which will self-polymerise to give poly(alkyleneimines).

Other polyamines with pendant amino groups are those derivable from haloepoxides, such as epichlorohydrin, and trialkylamines; from self-polymerisation of acrylic and vinyl monomers containing amino groups; from co-polymerisation of vinyl or acrylic monomers with suitable mono or polyamines, such as ethylenediamine; or from reaction of suitable polyfunctional vinyl or acrylate polymers with aldehydes, especially formaldehyde, and amines. Such polymers may be linear or branched and may be cross-linked by the addition of appropriate amounts of polyfunctional amines.

Preferred polyamines are poly-guanides and -biguanides, poly(alkyleneamines) and poly(hydroxyalkyleneamines) such as poly(ethyleneamine) and poly(2-hydroxypropyleneamine) and crosslinked derivatives thereof. Other polyamines include ammonium, especially quaternery ammonium, derivatives of the aforementioned polyamines in which some or all the amino groups are in the form of ammonium, especially quaternary ammonium, groups. Examples of preferred cationic agents are co-polymers of formaldehyde and dicyandiamide such as MATEXIL FC-PN (ICI); poly(-dimethyldialkylammonium halides) having molecular weights from very low to high corresponding to intrinsic viscosities (at 25° C.) from 0.1 to 1.3 dl/g, such as MATEXIL FC-ER (ICI) and the AGEFLOC WT series of products (CPS); copolymers of N,N-dimethylbenzylamine, 2,2'-dichlorodiethylether and dimethylamine and/or N-methylbenzylamine, such as BASOLAN F (BASF); polymeric biguanides such as VANTOCIL IB (ICI); and, more especially, poly(hydroxyalkylammonium halides), derived from co-polymerisation of ammonia, methylamine or dimethylamine and epichlorohydrin having molecular weights from very low to high, corresponding to intrinsic viscosities (at 25° C.) from 0.04 dl/g to 0.5 dl/g, such as the AGEFLOC A and AGEFLOC B series of products (CPS). An especially preferred cationic agent is a very low molecular weight poly(2-hydroxypropylammonium chloride) (intrisic viscosity 0.1 dl/g at 25° C.) which is available as AGEFLOC B-50 (CPS).

The treatment of the dyed and syntanned polyamide textile material is conveniently carried out at a temperature up to 100° C., preferably from 20° C. to 60° C. for up to 2 hours, preferably from 15 minutes to 1 hour with from 0.1% to 8% of the cationic agent, preferably from 0.5% to 2.5%, by weight based on the weight of dyed, syntanned polyamide textile material. The treatment is conveniently performed at any pH up to neutral (7.0) but is preferably performed at pH from 1.5 to 5. The treatment may be accompanied by a concurrent treatment with a softening agent, especially with a non-ionic or cationic softening agent to improve the feel or softness of the dyed and after-treated textile material.

The invention also relates to a dyed, syntanned textile material which has been submitted to the present process.

The invention is further illustrated by the following Examples in which all parts and percentages are by weight unless otherwise indicated.

PROCEDURE A

Dyeing of Textile Material

Samples of fabrics knitted from conventional nylon 6.6 yarn (1.5 denier; 78F46) and micro-fibre nylon 6.6 yarn (0.8 denier; 85F92) were prepared and dyed in a conventional manner at a liquor to goods ratio of 20:1 with Dye 1 (CI Acid Blue 25) at the levels of 1% and 2% of dye on fibre. To each sample of knitted fabric in the dyebath at 40° C., was added 1% of a scouring agent, a 75:25 mixture of sulphated methyloleate and oleylcetyl alcohol-10E, (MATEXIL LA-NS, ICI), 1% formic acid and 1% ammonium acetate (all with respect to the fibre) and the pH adjusted to 4.5. After 10 minutes 1% or 2% Dye 1 and 1% of a levelling agent, octadecylamine-20EO (MATEXIL LC-CWL, ICI), were added. After a further 15 minutes, the temperature of the dyebath was raised at a steady rate to 98° C. over 30 minutes at which it was held for 45 minutes and then cooled to 40° C. Each sample of dyed material was then rinsed thoroughly in water and air dried.

PROCEDURE B

Syn-tanning of Dyed Textile Material

Each sample of dyed material from A was syntanned by treatment with an anionic syntan agent, aqueous solution of condensate of a phenolsulphonic acid with formaldehyde and sulphonyl-bisphenol sodium salt, (MATEXIL FA-SNX, ICI) at 2% syntan agent on fibre for 30 minutes at 80° C. with a liquor to goods ratio of 50:1. Each sample of the dyed syntanned material was rinsed thoroughly in cold water but not dried.

EXAMPLE 1

After-treatment of Syntanned Dyed Textile Material

Each wet sample of syntanned, dyed, textile material from B was after-treated with one of the cationic agents described in Table 1 at the level of 2% cationic agent on fibre in a fresh dyebath for 20 minutes at 50° C. and pH 6.5. Each sample of after-treated, syntanned, dyed, textile material was rinsed thoroughly in water and air dried.

EXAMPLE 2

Assessment of After-treated Syn-tanned Dyed Textile Material

Each sample of after-treated, syntanned, dyed textile material was assessed for wash-fastness in accordance with the ISO CO6/C2 wash fastness test. Assessments of the shade change in the sample under test and the staining on an adjacent piece of white Nylon 6.6 or cotton fabric were made by comparison with standard Grey Scales rated from 1 to 5. In each assessment the after-treated, syntanned, dyed, textile material was compared with one or two controls (identified as Ex C1, C2, D1, D2, E1 & F1 in Table 1). The first control (C1, D1, E1, F1) was of the same textile material dyed with the same % of the same dye but syntanned as in Procedure B with 4% of MATEXIL FA-SNX but not aftertreated and the second control (C2 & D2) was of the same material dyed with the same percentage of the same dye, not syntanned but after-treated with 4% of the same after-treatment agent. Each intregral increment on the Grey Scale (e.g. from 3 to 4 or from 2–3 to 3–4) represents a 100% difference in the measured property, i.e. colour change or staining.

The results of the assessments are shown in Table 1.

TABLE I

| | | | | Grey Scale Rating | | |
|---|---|---|---|---|---|---|
| | | | | Sample | Staining on Adjacent Fabrics | |
| Ex | Cationic Agent | Fibre | % Dye | Shade Change | Nylon | Cotton |
| C1 | — | MF | 1 | 2 | 2–3 | 3 |
| C2 | — | MF | 1 | 2 | 2 | 2 |
| 1a | MATEXIL FC-ER | MF | 1 | 3 | 3 | 3–4 |
| 1b | MATEXIL FC-PN | MF | 1 | 2–3 | 2–3 | 3 |
| D1 | — | MF | 2 | 2 | 2–3 | 3 |
| D2 | — | MF | 2 | 2 | 2 | 3 |
| 2a | MATEXIL FC-ER | MF | 2 | 3 | 3 | 3–4 |
| 2b | MATEXIL FC-PN | MF | 2 | 2–3 | 2–3 | 3 |
| E1 | — | Conv | 1 | 2–3 | 2–3 | 3 |
| 3 | MATEXIL FC-ER | Conv | 1 | 3 | 3 | 3 |
| F1 | — | Conv | 2 | 2–3 | 2–3 | 3 |
| 4a | MATEXIL FC-ER | Conv | 2 | 3 | 3 | 3–4 |
| 4b | AGEFLOC A50LV | Conv | 2 | 3 | 3 | 3–4 |
| 4c | AGEFLOC A50V | Conv | 2 | 3 | 3 | 3–4 |
| 4d | AGEFLOC B50 | Conv | 2 | 3–4 | 3–4 | 4 |
| 4e | VANTOCIL IB | Conv | 2 | 3 | 3 | 3–4 |
| 4f | AGEFLOC B4508 | Conv | 2 | 3 | 3 | 3–4 |

Notes:
MF means microfibre yarn as defined in Procedure A
Conv means conventional yarn as described in Procedure A The results in Table 1 demonstrate that in each case the aftertreatment with the cationic agent gives an improvement of at least 50% (½ a point on the Grey Scale) in one or more of the properties measured which is significant in terms of the commercial viability of the dye, particularly in respect of its performance with micro-fibre nylon.

EXAMPLE 3

Procedures A & B were repeated using the same micro-fibre Nylon 6.6 yarn alone but, in place of the 1% or 2% of CI Acid Blue 25, the following commercial dyes mixtures at the indicated percentages on fibre:

| Dye 2 (Navy) | | Dye 3 (Green) | |
|---|---|---|---|
| 2.50% | CI Acid Blue 113 | 1.80% | CI Acid Orange 67 |
| 0.29% | CI Acid Orange 67 | 2.24% | CI Acid Green |
| 0.39% | CI Acid Blue | 1.23% | CI Acid Blue 113 |
| 3.18% | Total Dye 2 | 5.27% | Total Dye 3 |

| Dye 4 (Maroon) | |
|---|---|
| 4.94% | CI Acid Red 119 |
| 0.86% | CI Acid orange 127 |
| 5.80% | Total Dye 4 |

and each resulting syntanned, dyed, textile material was submitted to the after-treatment procedure described in Example 1.

EXAMPLE 4

Each sample of after-treated, syntanned, dyed textile material from Example 3, identified as 3a (Dye 2); 3b (Dye 3) and 3c (Dye 4), was assessed for wash-fastness in accordance with the BS1006:1990 AO4 and the results are shown in Table 2. Assessments of the shade change in the sample under test and the staining on an adjacent piece of white Nylon 6.6 or cotton fabric were made by comparison with standard grey scales rated from 1 to 5 as in Example 2. In each assessment the after-treated, syntanned, dyed, textile material was compared with three controls (identified as G1 to G3, H1 to H3 and I1 to I3 Table 2). In each case the first control (G1, H1, I1) was the same dyed, textile material which had been neither syntanned nor after-treated, the second control (G2, H2, I2) was the same dyed, textile material which had been syntanned with 4% of MATEXIL FA-SNX and the third control (G3, H3, I3) was the same dyed, textile material which had been fully back-tanned with 2% Tannic Acid and 1% Tartar Emetic.

TABLE 2

| | | | | Grey Scale Rating | | |
|---|---|---|---|---|---|---|
| | | | | Sample | Staining on Adjacent Fabrics | |
| Ex | Cationic Agent | Fibre | Dye | Shade Change | Nylon | Cotton |
| G1 | — | MF | 2 | 2 | 1 | 1-2 |
| G2 | — | MF | 2 | 2-3 | 2 | 2 |
| 2a | AGEFLOC B50 | MF | 2 | 3 | 2-3 | 3-4 |
| G3 | — | MF | 2 | 2 | 1 | 2-3 |
| H1 | — | MF | 3 | 2 | 1 | 3-4 |
| H2 | — | MF | 3 | 2-3 | 2 | 3-4 |
| 2b | AGEFLOC B50 | MF | 3 | 3 | 2-3 | 4 |
| H3 | — | MF | 3 | 2 | 1 | 2 |
| I1 | — | MF | 4 | 2 | 1 | 2 |
| I2 | — | MF | 4 | 2-3 | 2 | 2-3 |
| 2b | AGEFLOC B50 | MF | 4 | 3 | 2-3 | 3-4 |
| I3 | — | MF | 4 | 2 | 1 | 2 |

Notes: MF means microfibre yarn as defined in Procedure A

The results in Table 2 demonstrate that in each case the aftertreatment with the cationic agent gives an improvement of at least 50% (½ a point on the Grey Scale) in one or more of the properties measured. This is a significant improvement in terms of the commercial viability of the dye, particularly in respect of its performance on micro-fibre nylon.

Standard light-fastness assessments of the samples and controls in Examples 3 and 4 showed that the syntanning and after-treatment had no appreciable effect on light-fastness.

We claim:

1. A process which comprises submitting a polyamide microfibre textile material, which has been dyed with an acid dye and subsequently treated with an acidic syntan, to treatment at a pH of from 1.5 to 5 with a cationic agent having a plurality of groups selected from the class consisting of amino groups and quaternary ammonium groups, wherein the cationic agent is a polymer of a cationic monomer or copolymer of a cationic monomer and another comonomer.

2. A process according to claim 1 wherein the polyamide textile material contains micro-fibre yarn.

3. A process according to claim 1, wherein the treatment with the cationic agent carried out at a temperature of 20° C. to 60° C. for 15 minutes to one hour.

4. A process according to claim 1, wherein the polyamide textile material is treated with 0.1 to 8% of the cationic agent based on the weight of dyed, syntanned polyamide textile material.

5. A process according to claim 1, wherein the cationic agent is a copolymer of formaldehyde and dicyandiamide, a poly(dimethyldialkylammonium halide), a copolymer of N,N-dimethylbenzylamine, 2,2'dichlorodiethylether and at least one of dimethylamine and N-methylbenzylamine, a polymeric biguanide, or a poly(-hydroxyalkylammonium halide).

6. A process according to claim 5 wherein the cationic agent is poly(2-hydroxypropylammonium chloride).

* * * * *